US010138895B2

(12) United States Patent
Cheng et al.

(10) Patent No.: US 10,138,895 B2
(45) Date of Patent: Nov. 27, 2018

(54) FAN ROTOR MECHANISM

(71) Applicant: ASIA VITAL COMPONENTS CO., LTD., New Taipei (TW)

(72) Inventors: Min-Sheng Cheng, New Taipei (TW); Te-Chung Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 25 days.

(21) Appl. No.: 15/455,053

(22) Filed: Mar. 9, 2017

(65) Prior Publication Data

US 2018/0258941 A1 Sep. 13, 2018

(51) Int. Cl.

| | |
|---|---|
| ***H02K 1/04*** | (2006.01) |
| ***F04D 25/08*** | (2006.01) |
| ***F04D 25/06*** | (2006.01) |
| ***F04D 29/28*** | (2006.01) |
| ***F04D 29/42*** | (2006.01) |
| ***F04D 29/056*** | (2006.01) |
| ***F04D 29/054*** | (2006.01) |

(52) U.S. Cl.

CPC ..... *F04D 25/08* (2013.01); *F04D 25/06* (2013.01); *F04D 29/054* (2013.01); *F04D 29/056* (2013.01); *F04D 29/282* (2013.01); *F04D 29/4226* (2013.01)

(58) Field of Classification Search

CPC ..... H02K 15/03; H02K 1/28
USPC ..... 310/43, 67 R, 89, 156.01–156.83
See application file for complete search history.

(56) References Cited

U.S. PATENT DOCUMENTS

2002/0047427 A1* 4/2002 Shiga ..... H02K 1/2786 310/156.13
2007/0114860 A1* 5/2007 Chen ..... F04D 25/0613 310/67 R
2007/0145842 A1* 6/2007 Zhu ..... F04D 29/582 310/88
2010/0264758 A1* 10/2010 Strohm ..... H02K 1/2786 310/43

(Continued)

FOREIGN PATENT DOCUMENTS

CN 201228662 Y 4/2009
CN 102808801 A 12/2012
CN 104100553 A 10/2014

(Continued)

*Primary Examiner* — Thanh Lam
(74) *Attorney, Agent, or Firm* — C. G. Mersereau; Nikolai & Mersereau, P.A.

(57) ABSTRACT

A fan rotor mechanism includes a fan impeller, a case and an adhesive body. The fan impeller has a hub and multiple fan blades. The hub has a first top section and a first peripheral section together defining a receiving space for receiving the case. The case has a receptacle for receiving therein at least one magnetic component. The case and the magnetic component define therebetween a filling gap. The case is formed with at least one perforation in communication with the filling gap. The adhesive body is filled up in the filling gap. By means of the structural design of the fan rotor mechanism, the fan rotor mechanism is applicable to various magnetic components with different sizes. Therefore, is unnecessary to manufacture different sizes of molds for different sizes of cases so that the fan rotor mechanism has high universality and is manufactured at lower cost.

11 Claims, 11 Drawing Sheets

(56) References Cited

U.S. PATENT DOCUMENTS

| | | | | |
|---|---|---|---|---|
| 2011/0074230 | A1* | 3/2011 | Hasegawa | F04D 29/023<br>310/43 |
| 2011/0274556 | A1* | 11/2011 | Chen | H02K 1/187<br>416/244 R |

FOREIGN PATENT DOCUMENTS

| | | |
|---|---|---|
| TW | M264386 | 5/2005 |
| TW | I400781 B1 | 7/2013 |

* cited by examiner

FAN ROTOR MECHANISM

BACKGROUND OF THE INVENTION

1. Field of the Invention

The present invention relates generally to a fan rotor mechanism, and more particularly to a fan rotor mechanism, which has high universality and is manufactured at much lower cost.

2. Description of the Related Art

Along with the miniaturization and high-performance development of electronic products, the requirement for heat dissipation has become higher and higher. Therefore, with the development of the electronic products, the heat dissipation technique has been improved to enhance the heat dissipation performance. A cooling fan has the advantages of low cost, mature technique, etc. so that various cooling fans are widely applied to the electronic products as heat dissipation devices.

FIGS. 1A and 1B show a conventional fan rotor mechanism including a case 10, a fan impeller 11 and a magnetic component 12. The fan impeller 11 has a receiving space 110 for receiving therein the case 10. The magnetic component 12 is annularly disposed along the inner circumference of the case 10.

According to the structural design of the conventional fan rotor mechanism, the size of the case 10 is varied with the change of the size of the magnetic component 12 annularly disposed along the inner circumference of the case 10. That is, in the case that the magnetic component 12 has a smaller size, the case 21 will have to have a smaller size in conformity with the size of the magnetic component 12 so that the magnetic component 12 can be tightly and securely assembled with the inner circumference of the case 10 by press fit. Reversely, in the case that the magnetic component 12 has a larger size, the case 21 will have to have a larger size in conformity with the size of the magnetic component 12 so that the magnetic component 12 can be tightly and securely assembled with the case 10. Therefore, it is necessary to manufacture different sizes of molds for different sizes of cases 10 in accordance with different sizes of magnetic components 12. This leads to increase of the manufacturing cost.

According to the above, the conventional fan rotor mechanism has the following shortcomings:

1. It is necessary to manufacture different sizes of molds for different sizes of cases so that the manufacturing cost is increased.
2. The universality of the conventional fan rotor mechanism is relatively poor.

It is therefore tried by the applicant to provide a fan rotor mechanism, which can be more universally used and is manufactured at much lower cost to eliminate the shortcomings of the conventional fan rotor mechanism.

SUMMARY OF THE INVENTION

It is therefore a primary object of the present invention to provide a fan rotor mechanism, which has high universality.

It is a further object of the present invention to provide a fan rotor mechanism, which is manufactured at much lower cost.

To achieve the above and other objects, the fan rotor mechanism of the present invention includes a fan impeller, a case and an adhesive body. The fan impeller has a hub and multiple fan blades. The hub has a first top section and a first peripheral section axially extending from a periphery of the first top section. The first top section and the first peripheral section together define a receiving space. The fan blades are annularly disposed on an outer circumference of the first peripheral section.

The case is received in the receiving space. The case has a receptacle for receiving therein at least one magnetic component. The case and the magnetic component define therebetween a filling gap. The case is formed with at least one perforation in communication with the filling gap.

The adhesive body is filled up in the filling gap.

According to the structural design of the present invention, the adhesive body is filled up in the filling gap. When a magnetic component with a larger size is received in the receptacle of the case, the amount of the adhesive body filled in the filling gap is less. Reversely, When a magnetic component with a smaller size is received in the receptacle of the case, the amount of the adhesive body filled in the filling gap is more. That is, the size of the case is not limited by the size of the magnetic component received in the receptacle of the case. In the case that the magnetic component is larger, the amount of the adhesive body is less. Reversely, in the case that the magnetic component is smaller, the amount of the adhesive body is more. Accordingly, the fan rotor mechanism can be more universally used. Moreover, it is unnecessary to manufacture different sizes of molds for different sizes of cases. Therefore, the manufacturing cost is lowered.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
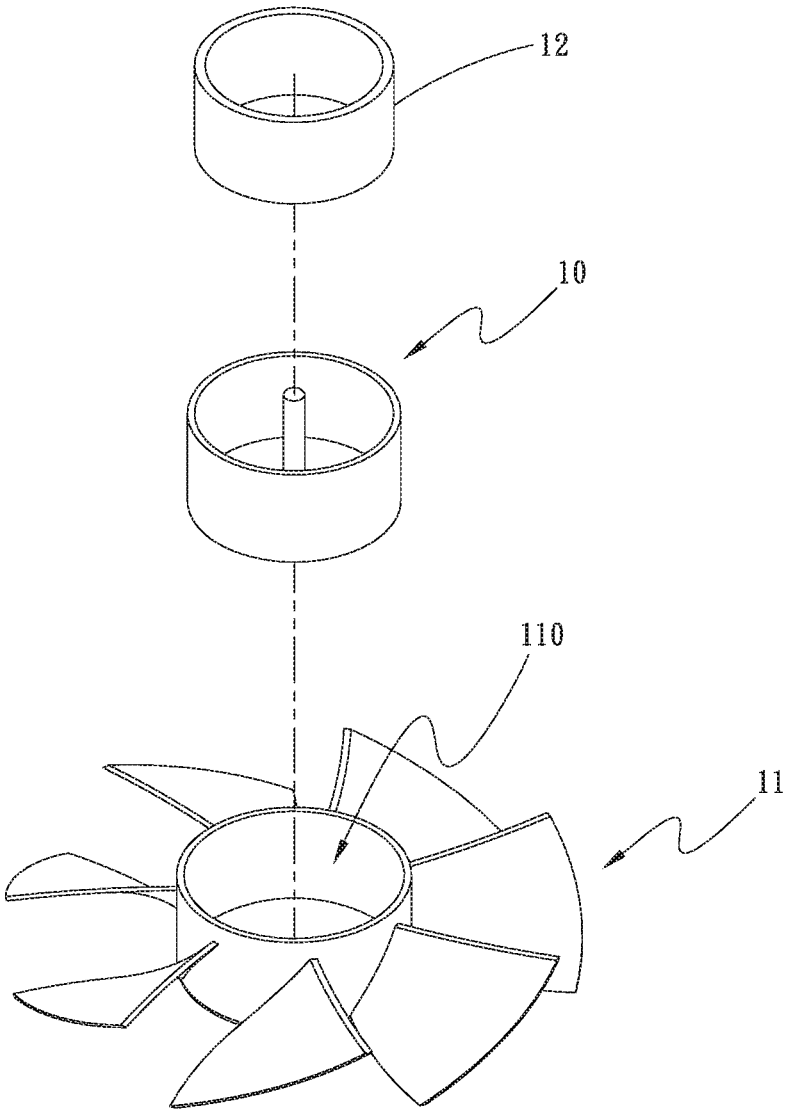
(prior art) Fig. 1A
FIG. 1A is a perspective exploded view of a conventional fan rotor mechanism.
Figure 1B:
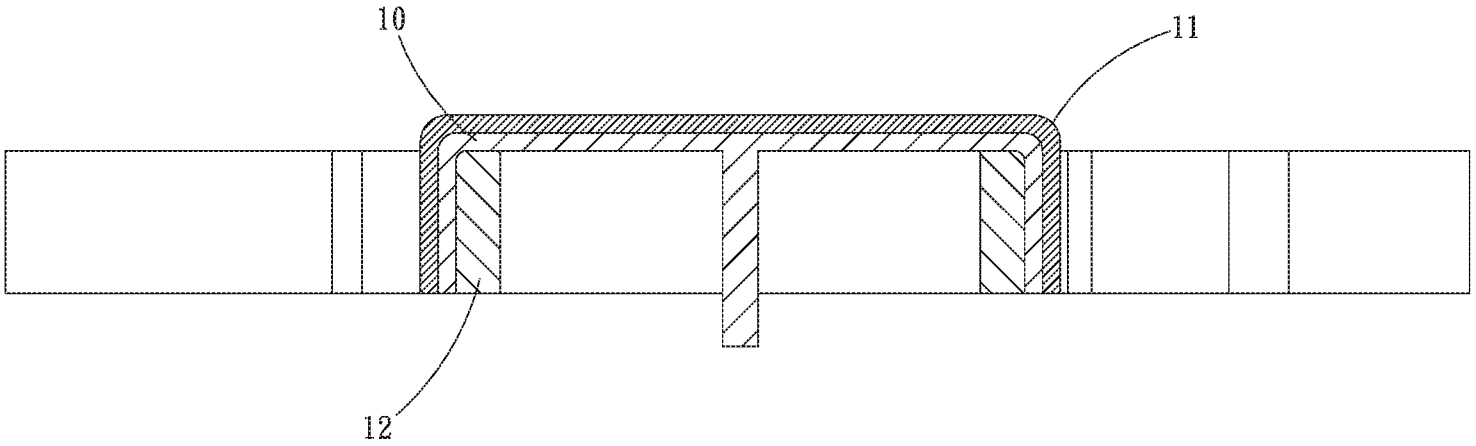
(prior art) Fig. 1B
FIG. 1B is a sectional view of the conventional fan rotor mechanism.
Figure 2A:
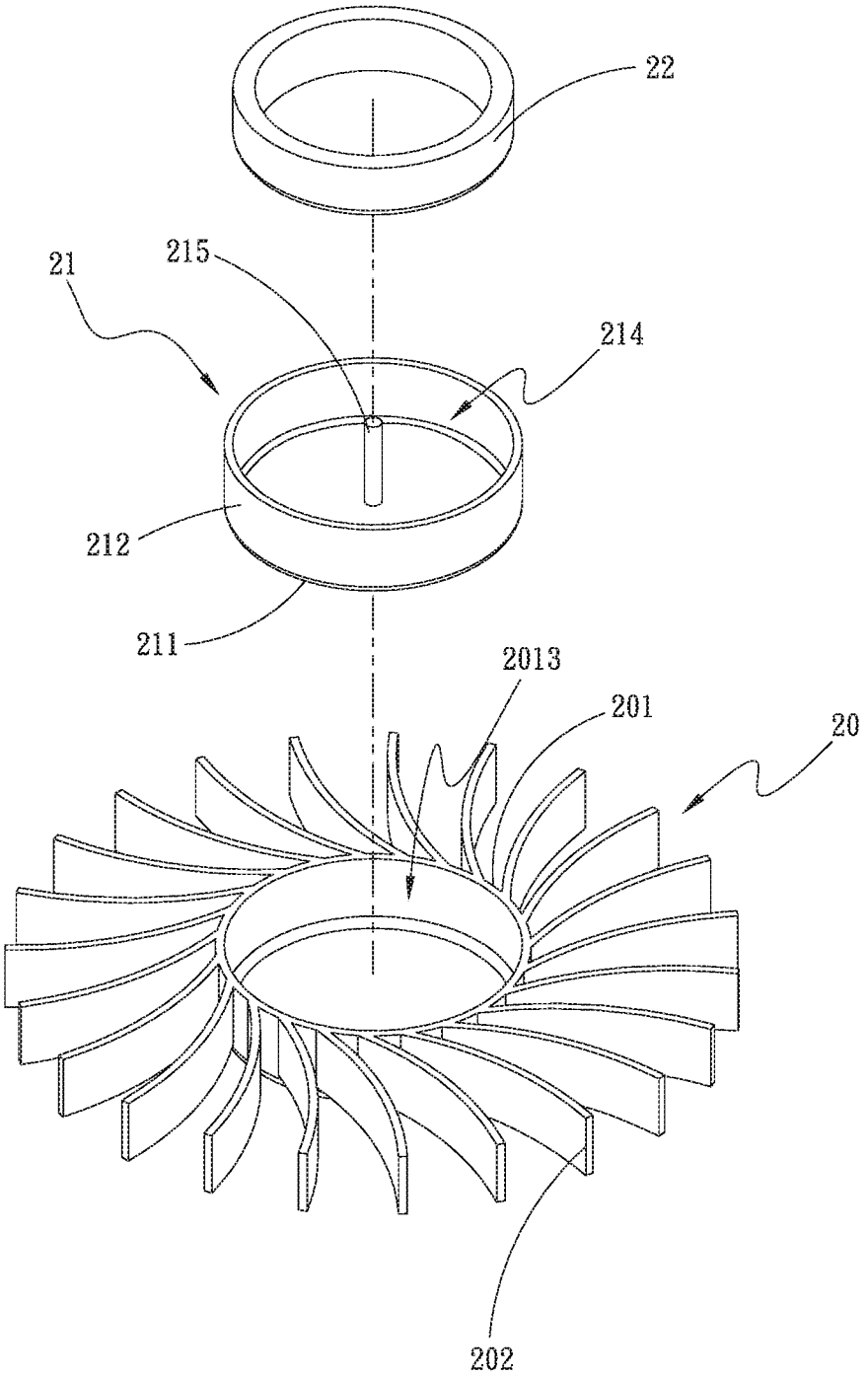
FIG. 2A is a perspective exploded view of a first embodiment of the fan rotor mechanism of the present invention.
Figure 2B:
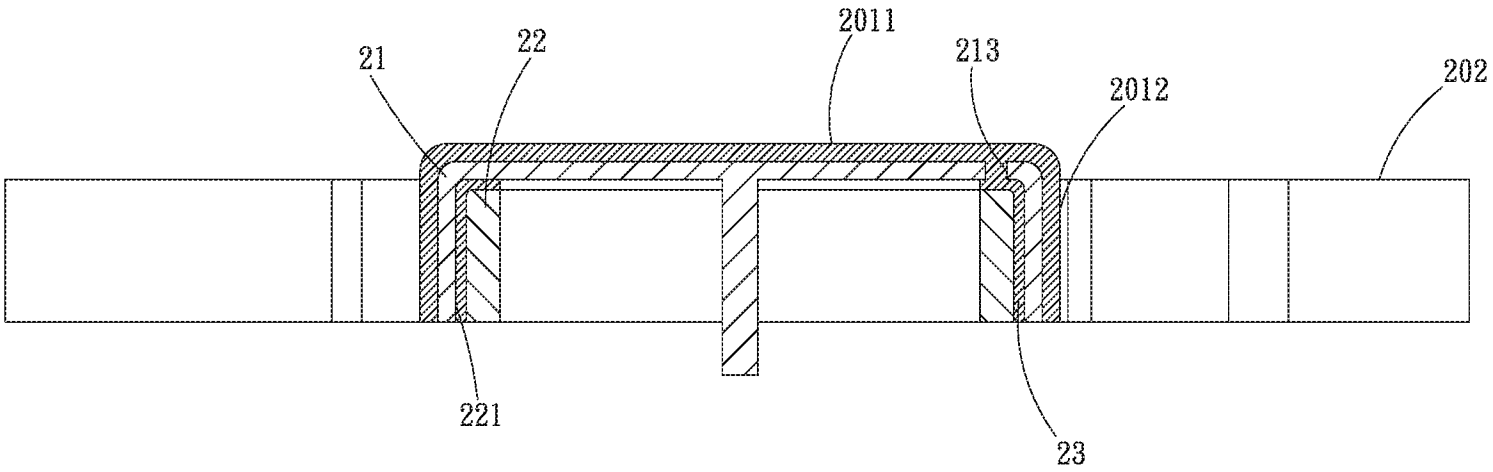
FIG. 2B is a sectional view of the first embodiment of the fan rotor mechanism of the present invention.

Please refer to FIGS. 2A and 2B. FIG. 2A is a perspective exploded view of a first embodiment of the fan rotor mechanism of the present invention. FIG. 2B is a sectional view of the first embodiment of the fan rotor mechanism of the present invention. According to the first embodiment, the fan rotor mechanism of the present invention includes a fan impeller 20, a case 21 and an adhesive body 23. The fan impeller 20 has a hub 201 and multiple fan blades 202. The hub 201 has a first top section 2011 and a first peripheral section 2012 axially extending from a periphery of the first top section 2011. The first top section 2011 and the first peripheral section 2012 together define a receiving space 2013. The fan blades 202 are annularly disposed on outer circumference of the first peripheral section 2012.

The case 21 is received in the receiving space 2013. The case 21 has a receptacle 214 for receiving therein at least one magnetic component 22. The case 21 and the magnetic component 22 define therebetween a filling gap 221. In addition, the case 21 is formed with at least one perforation 213 in communication with the filling gap 221. The case 21 further has a shaft 215 positioned at a center of the case 21.

Moreover, the case 21 has a second top section 211 and a second peripheral section 212 axially extending from a periphery of the second top section 211. The second top section 211 and the second peripheral section 212 together define the receptacle 214.

The adhesive body 23 is filled up in the filling gap 221. The adhesive body 23 can be a thermoplastic adhesive or a polymer material.

Figure 3:
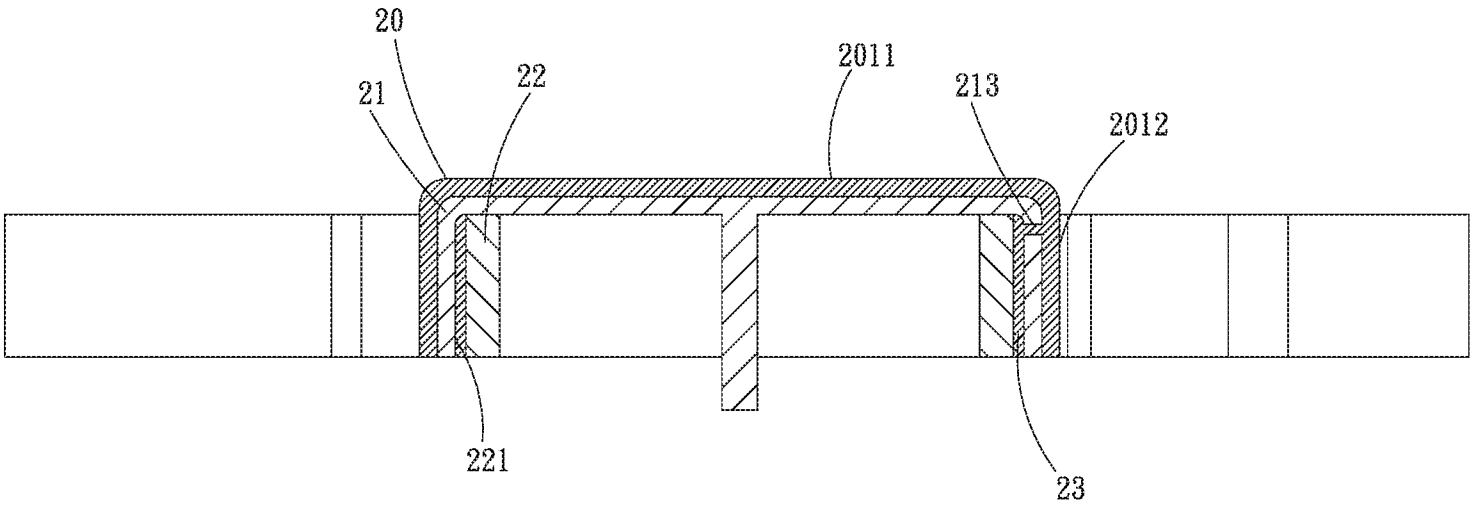
FIG. 3 is a sectional view of a second embodiment of the fan rotor mechanism of the present invention.
Figure 4:
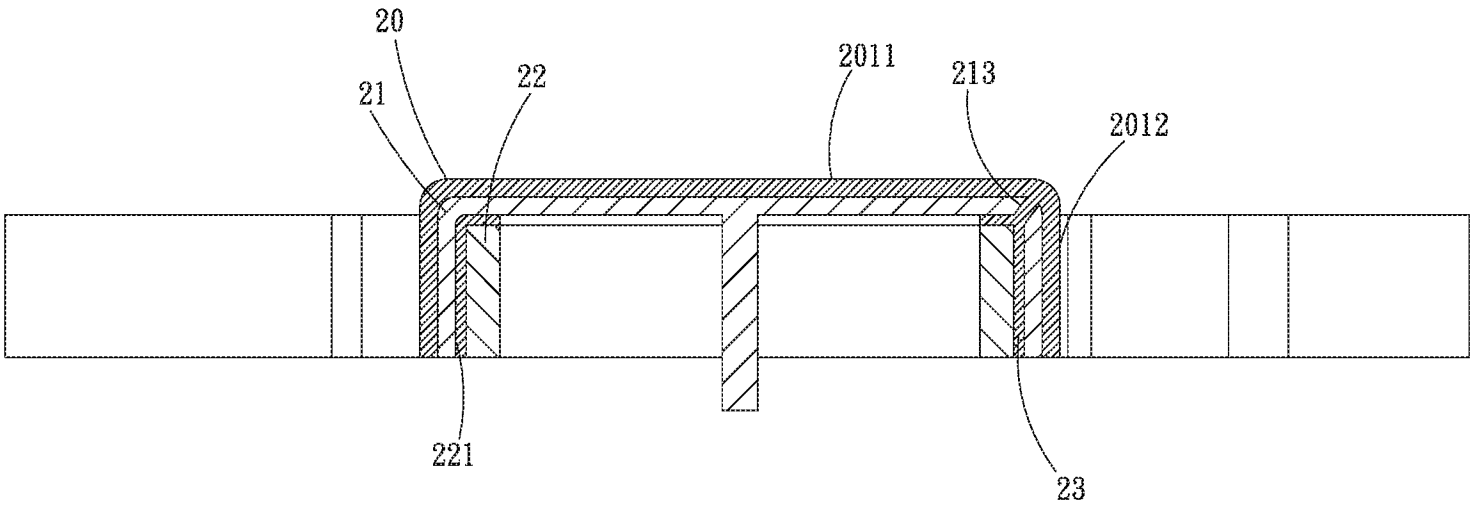
FIG. 4 is a sectional view of a third embodiment of the fan rotor mechanism of the present invention.

Please now refer to FIGS. 3 and 4 as well as FIGS. 2A and 2B. FIG. 3 is a sectional view of a second embodiment of the fan rotor mechanism of the present invention. FIG. 4 is a sectional view of a third embodiment of the fan rotor mechanism of the present invention. According to the structural design of the present invention, the perforation 213 communicates with the filling gap 221. The perforation 213 can be formed on the second top section 211 or the second peripheral section 212 or the junction between the second top section 211 and the second peripheral section 212. The adhesive body 23 is filled up in the filling gap 221. When a magnetic component 22 with a larger size is received in the receptacle 214 of the case 21, the filling gap 221 is smaller so that the amount of the adhesive body 23 filled in the filling gap 221 becomes less. Reversely, When a magnetic component 22 with a smaller size is received in the receptacle 214 of the case 21, the filling gap 221 is larger so that the amount of the adhesive body 23 filled in the filling gap 221 becomes more. That is, the size of the case 21 is not limited by the size of the magnetic component 22. In the case that the magnetic component 22 is larger, the amount of the adhesive body 23 filled in the filling gap 221 is less. Reversely, in the case that the magnetic component 22 is smaller, the amount of the adhesive body 23 filled in the filling gap 221 is more. Accordingly, in any case, the adhesive body 23 is always filled up in the filling gap 221 so that the magnetic component 22 can be securely received in the case 21. Therefore, the fan rotor mechanism can be more universally used. Moreover, it is unnecessary to manufacture different sizes of molds for different sizes of cases 21. Therefore, the manufacturing cost is lowered.

Figure 5:
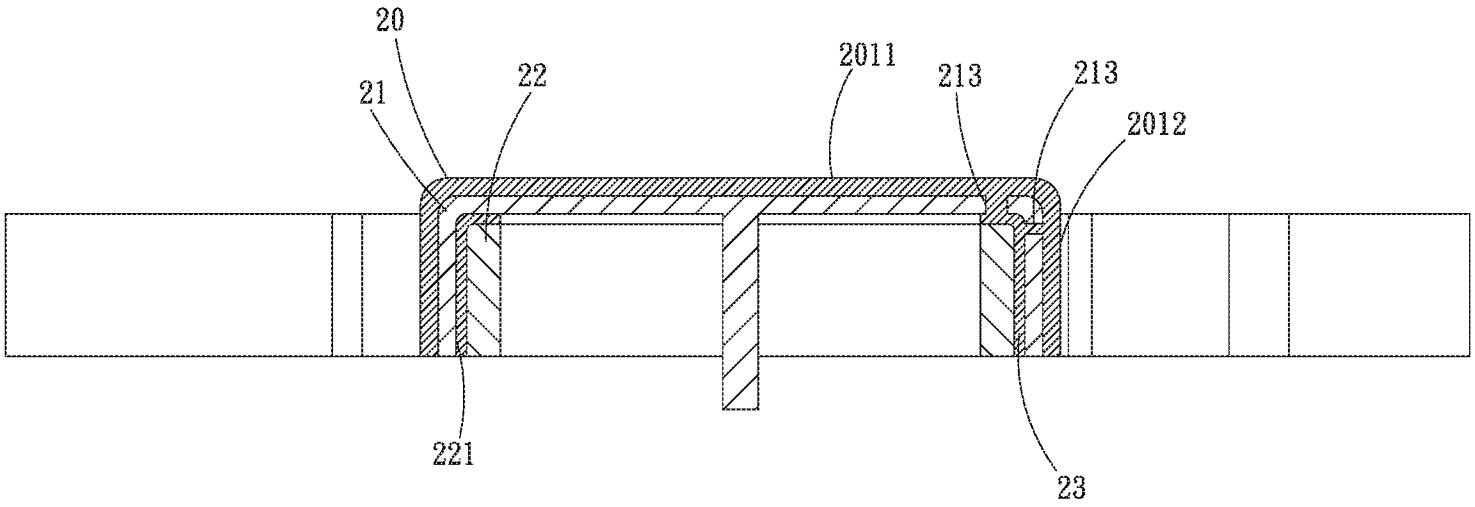
FIG. 5 is a sectional view of a fourth embodiment of the fan rotor mechanism of the present invention.
Figure 6:
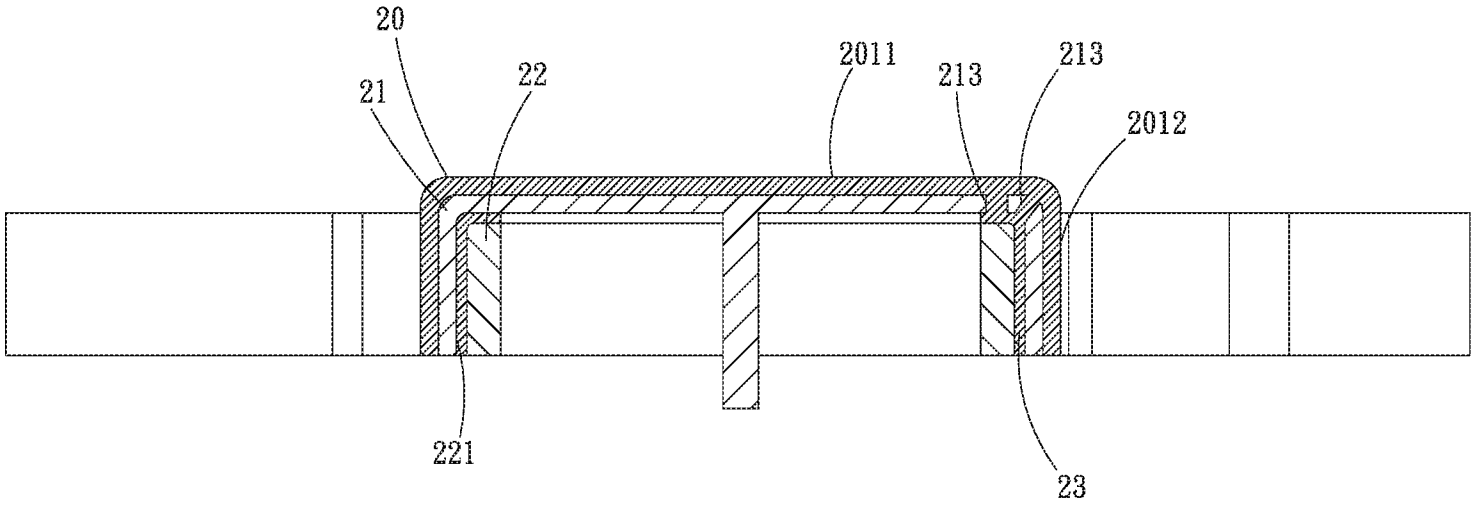
FIG. 6 is a sectional view of a fifth embodiment of the fan rotor mechanism of the present invention.
Figure 7:
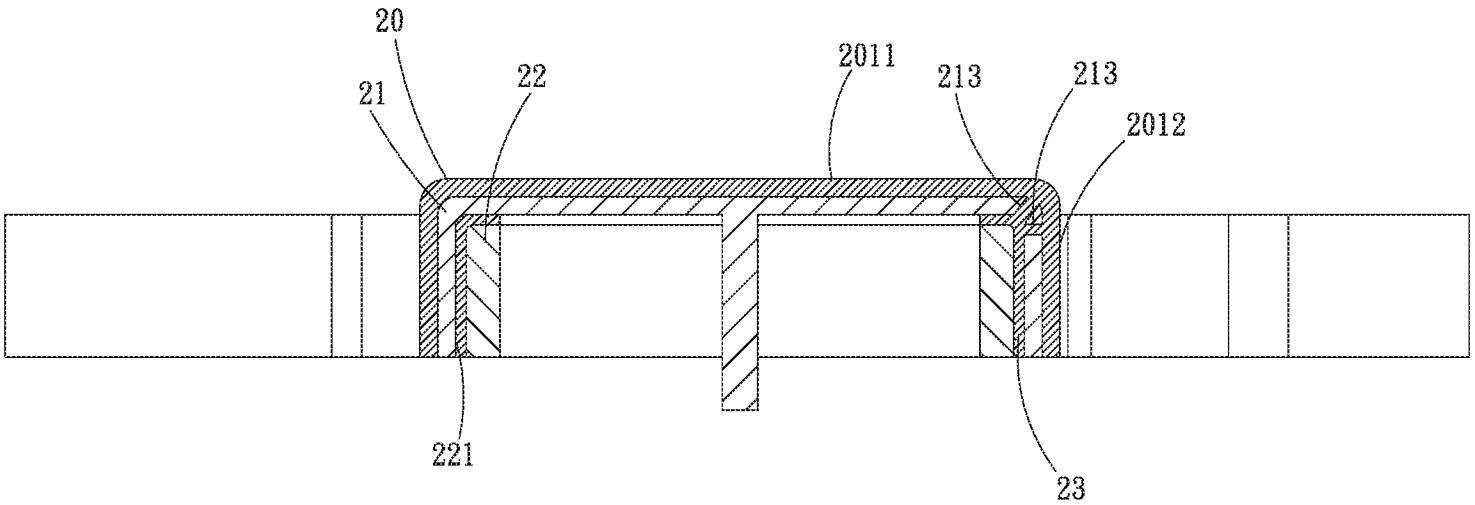
FIG. 7 is a sectional view of a sixth embodiment of the fan rotor mechanism of the present invention.

Please now refer to FIGS. 5, 6 and 7. FIG. 5 is a sectional view of a fourth embodiment of the fan rotor mechanism of the present invention. FIG. 6 is a sectional view of a fifth embodiment of the fan rotor mechanism of the present invention. FIG. 7 is a sectional view of a sixth embodiment of the fan rotor mechanism of the present invention. The fourth, fifth and sixth embodiments are partially identical to the first embodiment in component and relationship between the components and thus will not be repeatedly described hereinafter. The fourth, fifth and sixth embodiments are mainly different from the first embodiment in that there are two perforations 213 formed on the second top section 211 and the second peripheral section 212 of the case 21 or formed on the second top section 211 and the junction between the second top section 211 and the second peripheral section 212 or formed on the second peripheral section 212 and the junction between the second top section 211 and the second peripheral section 212. Accordingly, the adhesive body 23 is always filled up in the filling gap 221 so that the magnetic component 22 can be securely received in the case 21. Therefore, the fan rotor mechanism can be more universally used. Moreover, it is unnecessary to manufacture different sizes of molds for different sizes of cases 21. Therefore, the manufacturing cost is lowered.

Figure 8:
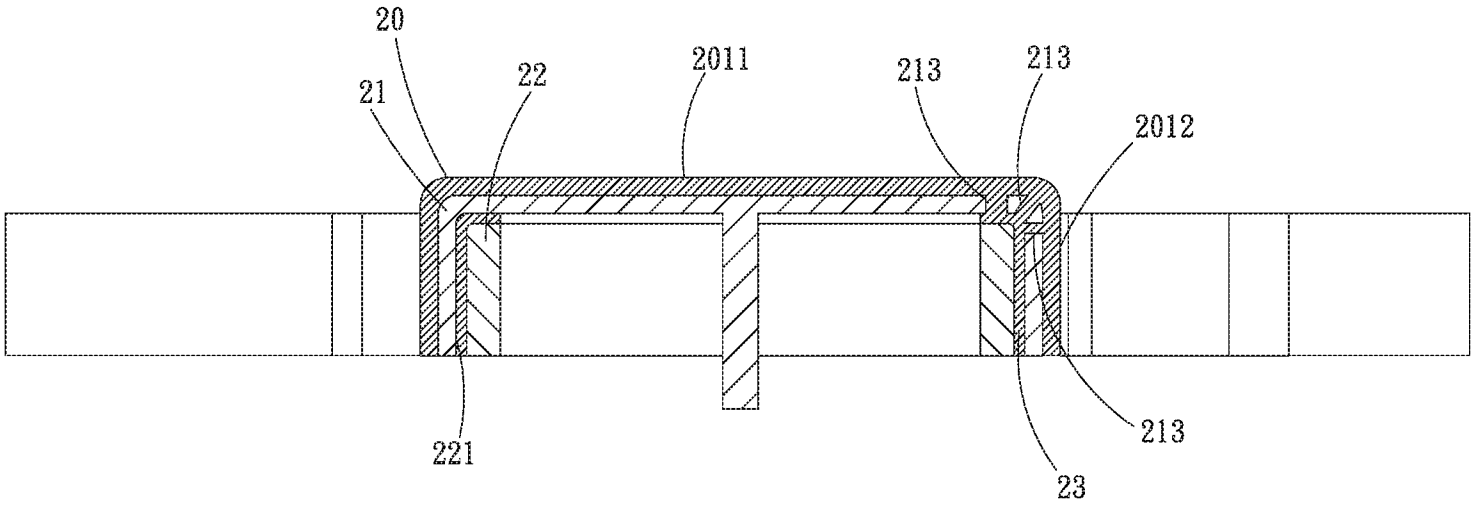
FIG. 8 is a sectional view of a seventh embodiment of the fan rotor mechanism of the present invention.

Please now refer to FIG. 8. FIG. 8 is a sectional view of a seventh embodiment of the fan rotor mechanism of the present invention. The seventh embodiment is partially identical to the above embodiments in component and relationship between the components and thus will not be repeatedly described hereinafter. The seventh embodiment is mainly different from the above embodiments in that there are three perforations 213 formed on the second top section 211 and the second peripheral section 212 and the junction between the second top section 211 and the second peripheral section 212. Accordingly, the adhesive body 23 is always filled up in the filling gap 221 so that the magnetic component 22 can be securely received in the case 21. Therefore, the fan rotor mechanism can be more universally used. Moreover, it is unnecessary to manufacture different sizes of molds for different sizes of cases 21. Therefore, the manufacturing cost is lowered.

Figure 9:
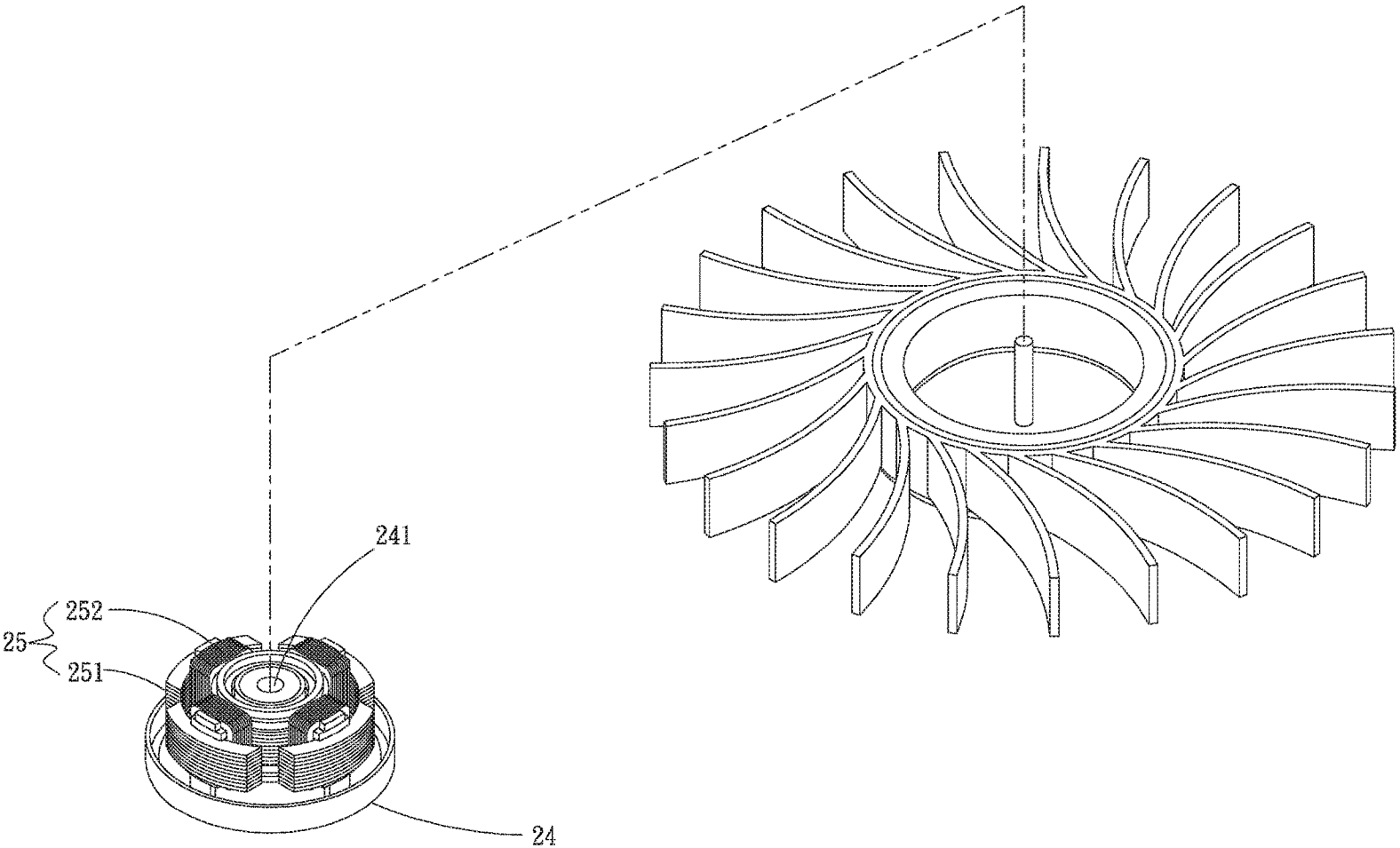
FIG. 9 is a perspective exploded view of an eighth embodiment of the fan rotor mechanism of the present invention.

Please now refer to FIG. 9. FIG. 9 is a perspective exploded view of an eighth embodiment of the fan rotor mechanism of the present invention. The eighth embodiment is partially identical to the above embodiments in component and relationship between the components and thus will not be repeatedly described hereinafter. The eighth embodiment is mainly different from the above embodiments in that the fan rotor mechanism further has a bearing cup seat 24 having a receiving section 241. The shaft 215 is received in the receiving section 241. A stator assembly 25 is fitted around the bearing cup seat 24. The stator assembly 25 is composed of multiple silicon steel sheets 251 stacked on each other. Multiple windings 252 are wound on the silicon steel sheets 251.

In conclusion, in comparison with the conventional fan rotor mechanism, the present invention has the following advantages:

1. The fan rotor mechanism of the present invention has high universality.
2. It is unnecessary to manufacture different sizes of molds for different sizes of cases. Therefore, the manufacturing cost is lowered.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan rotor mechanism comprising:

a fan impeller having a hub and multiple fan blades, the hub having a first top section and a first peripheral section axially extending from a periphery of the first top section, the first top section and the first peripheral section together defining a receiving space, the fan blades being annularly disposed on an outer circumference of the first peripheral section;

a case received in the receiving space, the case having a receptacle for receiving therein at least one magnetic component, the case and the magnetic component defining therebetween a filling gap, the case being formed with at least one perforation in communication with the filling gap; and an adhesive body filled up in the filling gap.

2. The fan rotor mechanism as claimed in claim 1, wherein the case further has a shaft positioned at a center of the case.

3. The fan rotor mechanism as claimed in claim 1, wherein the case has a second top section and a second peripheral section axially extending from a periphery of the second top section, the second top section and the second peripheral section together defining the receptacle.

4. The fan rotor mechanism as claimed in claim 3, wherein the perforation is formed on the second top section or the second peripheral section or a junction between the second top section and the second peripheral section.

5. The fan rotor mechanism as claimed in claim 3, wherein the perforations are formed on the second top section and the second peripheral section.

6. The fan rotor mechanism as claimed in claim 3, wherein the perforations are formed on the second top section and a junction between the second top section and the second peripheral section.

7. The fan rotor mechanism as claimed in claim 3, wherein the perforations are formed on the second peripheral section and a junction between the second top section and the second peripheral section.

8. The fan rotor mechanism as claimed in claim 3, wherein the perforations are formed on the second top section, the second peripheral section and a junction between the second top section and the second peripheral section.

9. The fan rotor mechanism as claimed in claim 3, wherein the adhesive body is a thermoplastic adhesive or a polymer material.

10. The fan rotor mechanism as claimed in claim 2, further comprising a bearing cup seat having a receiving section, the shaft being received in the receiving section.

11. The fan rotor mechanism as claimed in claim 10, wherein a stator assembly is fitted around the bearing cup seat, the stator assembly being composed of multiple silicon steel sheets and multiple windings.

* * * * *